US005652035A

United States Patent [19]

Tseng

[11] Patent Number: 5,652,035

[45] Date of Patent: Jul. 29, 1997

[54] SUFFICIENTLY RIGID YET EASILY DECOMPOSABLE TOILET PAPER

[76] Inventor: Chun-Jung Tseng, 86 Chung-Tou Lin, Chu Pei City, Hsin Chu Hsien, Taiwan

[21] Appl. No.: 649,026

[22] Filed: May 16, 1996

[51] Int. Cl.[6] ..... B32B 3/10

[52] U.S. Cl. ..... 428/43; 428/136

[58] Field of Search ..... 428/43, 136; 242/1

*Primary Examiner*—Alexander Thomas
*Attorney, Agent, or Firm*—Morton J. Rosenberg; David I. Klein

[57] ABSTRACT

Disclosed is a sufficiently rigid yet easily composable toilet paper which is divided into four parts, namely, an upper left, a lower left, an upper right, and a lower right parts. All the four parts are formed with a plurality of parallel broken lines. The broken lines in two adjacent parts extend in two directions normal to one another and in two diagonally opposite parts extend in the same direction, thereby, the toilet paper, when folded into four, is given sufficient rigidity and better rupture strength. The broken line each includes a serial of very fine slits. The very fine slits of two adjacent broken lines are alternately positioned. The broken lines form locally weakened portions on the toilet paper and thereby allow the latter to be more easily decomposed in water without causing the problem of a clogged flush toilet.

1 Claim, 3 Drawing Sheets

SUFFICIENTLY RIGID YET EASILY DECOMPOSABLE TOILET PAPER

BACKGROUND OF THE INVENTION

Toilet paper is now widely and necessarily used by people in their daily life and is considered as a milestone in the development of human civilization. When the industrial techniques keep advancing toward the production of toilet paper with better smell, softness and absorbency, it is more important for the human being to consider what kind of toilet paper shall less easily cause a clogged flush toilet and not adversely affect our environmental ecology.

The conventional toilet paper in the form of single sheet is usually rectangular in shape and has sufficient softness and flexibility. It is a common habit of people to use such conventional toilet paper by folding one or more sheets of them into four. Such folded sheets of toilet paper forms a thicker and solid body when they are thrown into the flush toilet and therefore requires longer time to be decomposed in a cesspool through microorganism and water. Another problem very possibly caused by such folded and bulky toilet paper is a clogged flush toilet and even a jammed sewerage system which is obviously a threat to the smooth drainage during a rainy season.

It is therefore desirable to have some kind of toilet paper which has substantially equivalent material as that of the conventional toilet paper but has improved structural design to facilitate the decomposition thereof. To meet this demand, the inventor has therefore developed a sufficiently rigid yet easily decomposable toilet paper which has sufficient rigidity to permit users to use them conveniently and satisfactorily while permits the toilet paper itself to be easily decomposed in water.

SUMMARY OF THE INVENTION

It is therefore a primary object of the present invention to provide a sufficiently rigid yet easily decomposable toilet paper which is divided into four parts, namely, an upper left, a lower left, an upper right, and a lower right parts. All the four parts are formed with a plurality of parallel broken lines. The broken lines in two adjacent parts extend in two directions normal to one another and in two diagonally opposite parts extend in the same direction, thereby, the toilet paper, when folded into four, is given sufficient rigidity and better rupture strength. The broken line each includes a serial of very fine slits. The very fine slits of two adjacent broken lines are alternately positioned. The broken lines form locally weakened portions on the toilet paper and thereby allow the latter to be more easily decomposed in water without causing the problem of a clogged flush toilet.

BRIEF DESCRIPTION OF THE DRAWINGS

The features of the present invention can be best understood by referring to the following detailed description of the preferred embodiment and the accompanying drawings, wherein.

DETAILED DESCRIPTION OF THE PREFERRED EMBODIMENT

Figure 1:
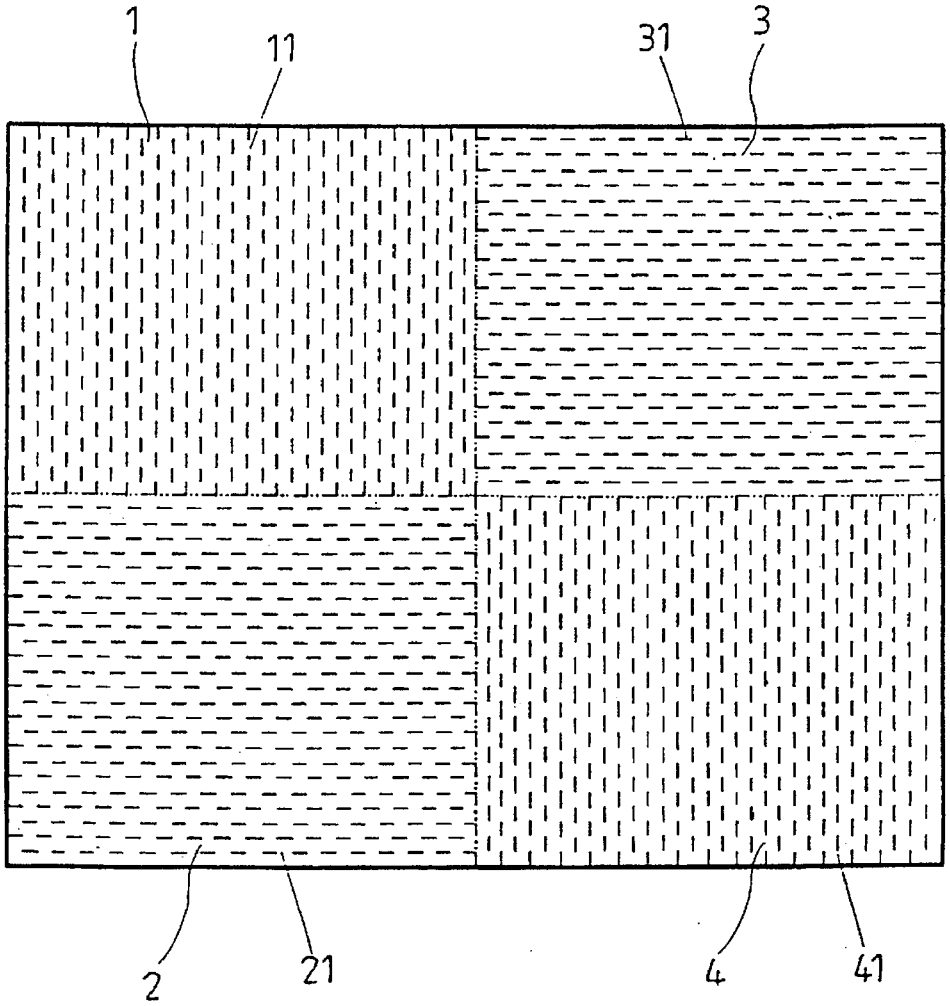
FIG. 1 is a plan view of the toilet paper according to the present invention.

Please refer to FIG. 1. The present invention relates to a toilet paper which has sufficient rigidity yet is easily decomposable in water. The toilet paper of the present invention has sufficient rigidity because it is suitable for folding into four layers as a user would usually do and is therefore has better rupture strength. On the other hand, the toilet paper of the present invention is physically easy-decomposable in water because it provides larger contact area with water.

Figure 2:
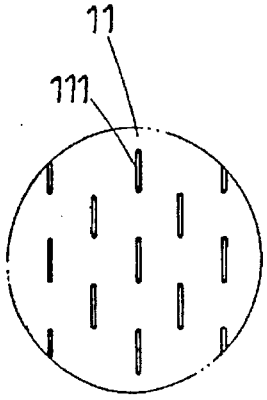
FIG. 2 is a fragmentary and enlarged plan view of FIG. 1.

The toilet paper of the present invention is substantially a sheet of rectangular paper. An overall surface of the paper is substantially divided into four equal parts, including an upper left part 1, a lower left part 2 below the part 1, an upper right part 3 to the right side of the part 1, and a lower right part 4 diagonally opposite to the part 1. All of these four parts 1, 2, 3 and 4 are formed on their surface with a plurality of parallel broken lines 11, 21, 31, and 41, respectively. These broken lines 11, 21, 31, 41 vertically cut into the surface of the toilet paper and respectively include a plurality of very fine slits. Taking the broken line 11 as an example, each line 11 is formed from a serial of very fine slits 111, and the very fine slits 111 in every two adjacent broken lines 11 are alternately positioned, as shown in FIG. 2. An internal peripheral wall of each very fine slit 111 creates a contact area with water and thereby considerably increases the total contact area of the toilet paper with water, permitting the toilet paper to be more easily decomposed in water. This situation is applicable to the broken lines 21, 31, and 41, too.

Furthermore, the broken lines in every two adjacent parts of the four parts of the toilet paper extend in two directions normal to one another. The case as shown in FIG. 1 is that broken lines 11 extend in the part 1 in a vertical direction while broken lines 21, 31 in the parts 2, 3, respectively, extend in a horizontal direction, that is, normal to the extending direction of the broken lines 11. And, broken lines 41 extend in a vertical direction, too, to normal to the extending direction of the broken lines 21, 31.

Figure 3:
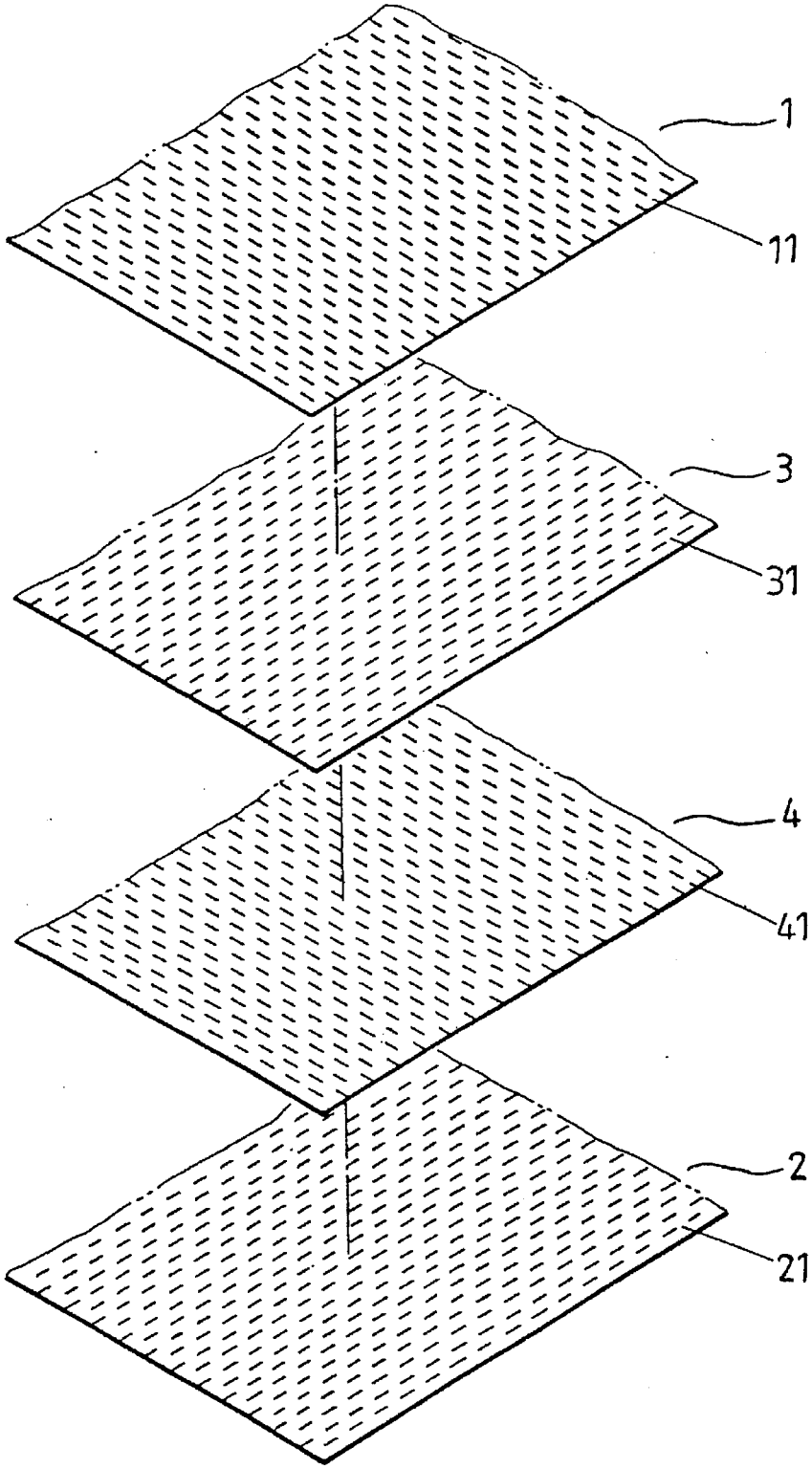
FIG. 3 is an exploded perspective showing the relation of the four parts of the toilet paper of the present invention in position when the toilet paper is folded into four.
Figure 4:
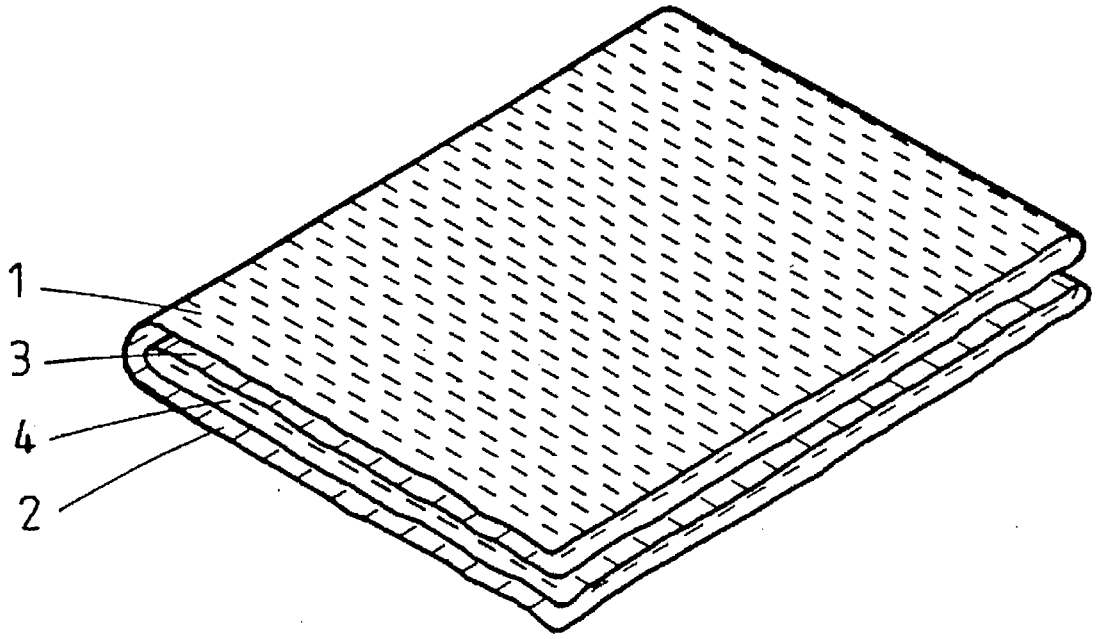
FIG. 4 is a perspective view of the toilet paper of the present invention in a folded-into-four state.

Please now refer to FIGS. 3 and 4 at the same time. FIG. 4 illustrates the toilet paper of the present invention is folded into four and FIG. 3 illustrates the four parts 1, 2, 3, 4 of the toilet paper in a cut-off and separate form for better show their relation in position when the toilet paper is folded into four. As shown, when a sheet of the toilet paper is folded into four as a user would usually do before he or she uses the paper in a toilet room, the broken lines on every two adjacent and superposed layers formed from two of the four parts 11, 21, 31, 41 extend in two directions normal to one another. The alternate extending directions of broken lines 11, 21, 31, 41 on these four parts or layers 1, 2, 3, 4 establish a reinforcement to the rupture strength of the toilet paper. More particularly, these alternate extending directions of broken lines 11, 21, 31, 41 on the folded toilet paper allow the paper to resist a stronger force applied by the user to the paper in the direction of Z axis.

When the used toilet paper is thrown into a flush toilet and is immersed in water (either clean water, cesspool water, or sewerage), the very fine slits 111 and so on forming the broken lines 11, 21, 31, 41 allow the toilet paper to absorb large quantity of water and is completely soaked, swollen, and decomposed by water from all three directions of X, Y, and Z axes. The broken lines 11, 21, 31, 41 cause the toilet paper to form locally weakened portions in a plane defined by the X and Y axes. Such locally weakened portions also permit the toilet paper to be more easily decomposed.

Although the rupture strength, the absorbency, the softness, and many other parameters of features of the toilet paper are generally decided by the types of pulp or cellulose (for instance, a sulfate pulp has better absorbency than that of a sulfite pulp), the arrangement or organization of fibers (that is, the fibers directions as shown from paper texture, the cross section and the Z axis direction of the toilet paper), the chemical additives, etc., the toilet paper of the present invention is provided with a better physical feature which enables better decomposability of the toilet paper.

In brief, the toilet paper of the present invention is characterized in that broken lines are provided on four parts of the toilet paper in horizontal and vertical directions (that is, in the directions of X and Y axes) alternately, so that a sheet of toilet paper folded into four layers shall have enhanced rupture strength to resist a force applied in the direction of Z axis, and that the used toilet paper thrown into the flush toilet is more easily decomposed by water due to these broken lines, thereby problems such as clogged flush toilet and jammed sewerage systems can be minimized to protect our environmental ecology.

It is to be understood that the form of the invention shown and disclosed is to be taken as a preferred embodiment of the invention and that various changes in the shape, size, and arrangement of parts may be resorted to without departing from the spirit of the invention or the scope of the subjoined claims.

What is claimed is:

1. A sufficiently rigid yet easily decomposable toilet paper, comprising a sheet of substantially rectangular paper, said paper being divided into four parts, namely, a first part located at an upper left corner of said paper, a second part located at a lower left corner of said paper, a third part located at an upper right corner of said paper, and a fourth part located at a lower right corner of said paper, and each of said first, second, third, and fourth parts being formed on their surfaces with a plurality of parallel broken lines, said broken lines on every two adjacent parts of said toilet paper extending in two directions normal to one another while said broken lines on every two diagonally opposite parts of said toilet paper extending in the same direction; said broken line each including a serial of very fine slits, and said very fine slits of every two adjacent broken lines being alternately positioned.

* * * * *